US010562080B1

(12) United States Patent
Carter

(10) Patent No.: US 10,562,080 B1
(45) **Date of Patent: *Feb. 18, 2020**

(54) METHOD AND APPARATUS FOR CLEANING AN OIL AND GAS WELL RISER ASSEMBLY WITH MULTIPLE TOOLS SIMULTANEOUSLY

(71) Applicant: TRI-STATE ENVIRONMENTAL, LLC, Houma, LA (US)

(72) Inventor: Anthony Scott Carter, Petal, MS (US)

(73) Assignee: Tri-State Environmental, LLC, Petal, MS (US)

( * ) Notice: Subject to any disclaimer, the term of this patent is extended or adjusted under 35 U.S.C. 154(b) by 42 days.

This patent is subject to a terminal disclaimer.

(21) Appl. No.: 15/842,472

(22) Filed: Dec. 14, 2017

Related U.S. Application Data

(63) Continuation of application No. 14/923,107, filed on Oct. 26, 2015, now Pat. No. 9,844,803.

(60) Provisional application No. 62/245,697, filed on Oct. 23, 2015, provisional application No. 62/191,991, filed on Jul. 13, 2015, provisional application No. 62/164,978, filed on May 21, 2015, provisional application No. 62/068,441, filed on Oct. 24, 2014.

(51) Int. Cl.

| | |
|---|---|
| ***B08B 9/04*** | (2006.01) |
| ***E21B 37/02*** | (2006.01) |
| ***E21B 37/04*** | (2006.01) |
| ***E21B 17/01*** | (2006.01) |

(52) U.S. Cl.
CPC ..... *B08B 9/04* (2013.01); *E21B 17/01* (2013.01); *E21B 37/02* (2013.01); *E21B 37/04* (2013.01)

(58) Field of Classification Search
CPC ..... B08B 9/04; B08B 9/0323; E21B 17/01; E21B 37/02; E21B 37/04; E21B 23/08
See application file for complete search history.

(56) References Cited

U.S. PATENT DOCUMENTS

| | | | |
|---|---|---|---|
| 1,704,364 | A | 5/1929 | Markley |
| 2,117,648 | A | 5/1938 | Bottorf |
| 5,159,956 | A | 11/1992 | Kurihara |
| 5,217,166 | A | 6/1993 | Schulze |
| 5,323,797 | A | 6/1994 | Rankin |
| 5,964,414 | A | 10/1999 | Hardy et al. |
| 6,158,076 | A | 12/2000 | Rutkowski et al. |
| 7,040,331 | B2 | 5/2006 | Garman et al. |

(Continued)

*Primary Examiner* — Mikhail Kornakov
*Assistant Examiner* — Natasha N Campbell
(74) *Attorney, Agent, or Firm* — Garvey, Smith & Nehrbass, Patent Attoryneys, L.L.C.; Charles C. Garvey, Jr.; Mackenzie D. Rodriguez

(57) ABSTRACT

The present invention relates to a method and apparatus for cleaning an oil and gas well riser section or assembly on location offshore that includes a larger diameter central pipe and a plurality of smaller diameter pipes that are spaced radially away from the central larger diameter pipe. Even more particularly, the present invention relates to an improved method and apparatus for cleaning oil and gas well riser sections wherein a specially configured cap or pair of caps are fitted to the ends of the riser which enable pressure washing cleaning tools (or a camera) to be inserted into and through a selected one of the pipes including either a smaller diameter of the pipes or the central larger diameter pipe and wherein the cap continuously collects spent cleaning fluid and debris, allowing the cleaning process to be done on location without transporting the riser section back onshore.

28 Claims, 13 Drawing Sheets

(56) References Cited

U.S. PATENT DOCUMENTS

| | | | |
|---|---|---|---|
| 8,118,091 | B2 | 2/2012 | Baker et al. |
| 2004/0050553 | A1 | 3/2004 | Edvardsen et al. |
| 2011/0052328 | A1 | 3/2011 | French et al. |
| 2014/0060849 | A1 | 3/2014 | Pathak et al. |

METHOD AND APPARATUS FOR CLEANING AN OIL AND GAS WELL RISER ASSEMBLY WITH MULTIPLE TOOLS SIMULTANEOUSLY

CROSS-REFERENCE TO RELATED APPLICATIONS

Incorporated herein by reference are U.S. Provisional Patent Application No. 62/068,441, filed 24 Oct. 2014; U.S. Provisional Patent Application No. 62/164,978, filed 21 May 2015; U.S. Provisional Patent Application No. 62/191,991, filed on 13 Jul. 2015; and, US Provisional Patent Application No. 62/245,697, filed 23 Oct. 2015. Priority of U.S. Provisional Patent Application No. 62/068,441, filed 24 Oct. 2014; U.S. Provisional Patent Application No. 62/164,978, filed 21 May 2015; U.S. Provisional Patent Application No. 62/191,991, filed on 13 Jul. 2015; and, U.S. Provisional Patent Application No. 62/245,697, filed 23 Oct. 2015, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the cleaning of oil and gas well riser sections or assemblies. More particularly, the present invention relates to a method and apparatus for cleaning an oil and gas well riser section or assembly on location offshore that includes a larger diameter central pipe and a plurality of smaller diameter pipes that are spaced radially away from the central larger diameter pipe. Even more particularly, the present invention relates to an improved method and apparatus for cleaning oil and gas well riser sections wherein a specially configured cap or pair of caps are fitted to the ends of the riser which enable pressure washing cleaning tools (or a camera) to be inserted into and through a selected one of the pipes including either a smaller diameter of the pipes or the central larger diameter pipe and wherein the cap continuously collects spent cleaning fluid and debris, allowing the cleaning process to be done on location without transporting the riser section back onshore.

2. General Background of the Invention

Oil and gas well riser sections typically include a central larger diameter pipe or tubular member that is surrounded by a plurality of three or four or more smaller diameter pipes held in spaced relation to the central pipe with plates or flanges. Flanges are provided at each end of the riser assembly or riser section. These flanges include openings that communicate with the bore or bores of the smaller diameter pipes. The flange has a central opening that communicates with the bore of the central larger diameter pipe.

In order to clean these pipe sections, it is necessary to remove rust, scale, debris, chemical deposits and the like from both the inner larger diameter pipe section bore as well as the smaller outer or peripherally placed pipe section bores. In order to avoid contamination, this cleaning process has been done onshore by removing and transporting the riser pipe sections from the offshore well, to an onshore cleaning site. Newer cleaning methods move the cleaning process offshore allowing the risers to be cleaned without removing them from the well. These methods require additional considerations to avoid having the removed rust, scale, debris, and chemical deposits be washed into the ocean. Additionally, there is a need to decrease the footprint of the machinery used in the cleaning process allowing it to be used offshore. There is also a need to speed up the cleaning process in order to make it more economical and efficient than removing the risers for cleaning.

BRIEF SUMMARY OF THE INVENTION

Applicant has improved on the method of cleaning risers by lowering the footprint and speeding up the cleaning process.

Because we are cleaning in multiple holes of the riser, possibly from each end simultaneously, our fabricators have designed a spool basket that holds 2 pneumatic feeders and 2 reels that coordinate with each respective feeder. This basket can also be adapted to hold 4 feeders and 4 reels by adding additional boxes and reels on top of the 2 initial boxes and reels. Additional boxes and reels could be added in the same manner allowing for multiple cleaning tools without taking up a larger footprint.

The reels hold the high-pressure water lines, so the lines won't cover much deck space lying on the ground Our fabricators have also improved upon the original control panel so that the improved control panel can control multiple feeders at once. Additionally, the control panel now can be placed right next to the Spool Basket, again, lowering the footprint. Our Spool Basket is fully automated, eliminating the need for a crew member to take up space near the caps. The output of water for 4 tools being run simultaneously is 15 gpm for the larger ID holes; 8 gpm for the choke, kill and boost lines; total gpm is 39; and total time to clean is consistently no more than 15 minutes.

The present invention improves upon the cleaning process of oil and gas well riser sections in speeding up the cleaning process and reducing the footprint of the cleaning equipment, which allows the cleaning process to take place on location rather than transporting the riser pipes onshore for cleaning.

The present invention thus provides a method and apparatus for cleaning oil and gas well riser sections wherein the riser section includes a central larger diameter pipe or tubular member having a flow bore and a plurality of smaller diameter pipes or tubular members that are preferably connected to the central larger diameter tubular member with flanges or spacers. Each of the smaller diameter tubular members has a flow bore.

The method includes placing a first cap or fitting on one end portion of the riser section. The fitting preferably covers an end of the larger diameter tubular member as well as the ends of the smaller diameter tubular members. The fitting preferably has multiple openings including one or more centrally located openings and a plurality of circumferentially spaced apart outer openings that are each spaced radially away from the one or more centrally located openings. The fitting can include a cylindrically shaped portion and a circular portion that is preferably joined to cylindrically shaped portion. A flexible sealing member preferably helps join the cap or fitting to an end of the riser assembly.

In a preferred embodiment, a similar cap is also secured to the opposite side of the pipe to be cleaned, allowing for cleaning to take place in both directions simultaneously while also collecting the debris.

The method includes inserting a first cleaning tool through the centrally located opening and into the larger diameter tubular member. The cleaning tool includes a pressure washing tool that cleans the inside surface of the larger diameter tubular member. A cable preferably supplies fluid under pressure to the first cleaning tool.

The method preferably includes the inserting of a second cleaning tool through one or more of the outer or peripherally placed openings and into one of the smaller diameter tubular members. The smaller diameter tubular members are cleaned with a second pressure washing tool that preferably cleans the inside surface of the smaller diameter tubular member or members, one after the other. In preferred embodiments, additional smaller diameter cleaning tools may also be used in the other smaller diameter tubular members simultaneously.

The method preferably includes the suction of fluid from the cleaning operations via a fitting or discharge that is preferably placed at a lower end portion of the fitting so that gravity flow can remove such cleaning fluid on a continuous basis.

The outer openings are preferably positioned along a curved line that is radially spaced outwardly of the centrally located opening or openings, the curved line traversing each of the outer tubular members.

In one embodiment, each centrally located opening is generally aligned with the bore of the larger diameter tubular member.

In one embodiment, one or more outer opening are generally aligned with the bore of a smaller diameter tubular member.

In one embodiment, the riser section or assembly has one end portion with an annular flange, each tubular member connected to the flange and the fitting preferably attaches to the annular flange.

In one embodiment, the flange has an outer diameter and the fitting has a peripheral skirt with a seal having a diameter that is about equal to the flange outer diameter. Further, the method preferably includes attaching the fitting at the peripheral skirt to the annular flange.

In one embodiment, there are two caps or fittings, each preferably having a fitting being attached to each end portion of the riser section or assembly. In this embodiment, the cleaning tools may all be fed into the bores from the same end, or, alternatively, one or more cleaning tools can be fed into the pipe from one end, while one or more additional cleaning tools are fed into different bores from the opposite end allowing cleaning to take place in both directions simultaneously.

In one embodiment, a suction is applied to each of the caps or fittings to subject all flow bores of the riser section to a vacuum during cleaning operations. Preferably, the vacuum at least partially contributes to securing the caps or fittings to the riser section.

In one embodiment, there are at least three outer openings.

In one embodiment, there are between two and twenty outer openings.

In one embodiment, the outer openings are preferably arranged in a circle.

In one embodiment, some of the outer openings are aligned with a smaller diameter tubular member bore and some of the outer openings are not aligned with a smaller diameter tubular member bore.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
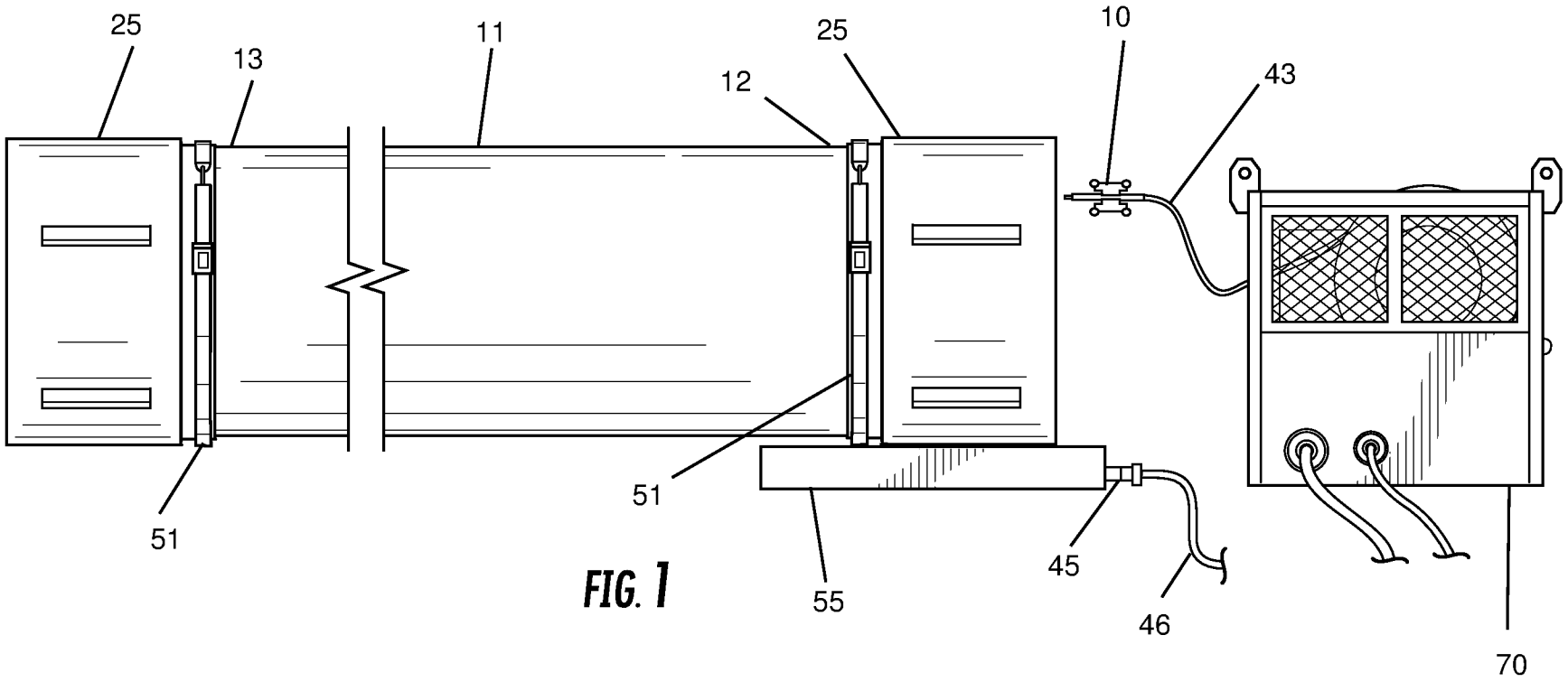
FIG. 1 is a schematic of a preferred embodiment of the method and apparatuses of the present invention with the cleaning tool out of the pipe.

Riser cleaning apparatus 10 is used to clean a riser assembly such as the riser assembly 11 shown in the drawings. Such a riser assembly 11 has a first end portion 12 and second end portion 13. Either or both of the end portions 12, 13 of the riser assembly 11 can be provided with an annular flange 14. The riser assembly 11 typically includes a larger diameter pipe or tubular member 15 surrounded by multiple smaller diameter pipes or tubular members 16.

The larger diameter pipe 15 has a pipe bore 17 of larger diameter. The smaller diameter pipes 16 each have a pipe bore 18 of smaller diameter. A flange 14 (not shown), preferably an annular flange, can be a part of a riser assembly 11. In the flange 14, there are openings 20 that do not align with a particular smaller diameter pipe 16. During cleaning of such a flange 14, plugs 21 or 22 (not shown) may be used to block the openings 20 so that fluid is not leaked through the openings 20. The riser assembly 11 can include an insulation layer or protective covering or coating 23.

The cleaning tool apparatus 10 of the present invention and the method of the present invention preferably employ one or more caps, fittings or shrouds 25. These caps, fittings or shrouds can be placed on one end portion 12 of the riser assembly 11 or on both end portions 12, 13 of the riser assembly 11.

Each cap, fitting or shroud 25 preferably includes a cylindrical section 26, a circular wall 27, and a concave portion or cavity 24. Wall 27 can be welded to cylindrical section 26. The cylindrical section 26 has an inner surface 28 and an outer surface 29. The circular wall has an inner surface 30 and an outer surface 31.

A gasket or seal 32 can be attached to cylindrical section 26. The gasket or seal 32 can be attached to the cylindrical section 26 using band 33 and fasteners such as rivets 34. Straps 51 can be used to hold each cap, fitting or shroud to a selected end portion 12, 13 of a riser assembly 11. One or more handles 35 can be attached (for example, welded) to cylindrical section 26 of cap or shroud 25. In one embodiment (not shown), a rope such as a wire rope is removably attached to the outer surface 29 in a manner to axially support the lifting of the cap 25.

Figure 4:
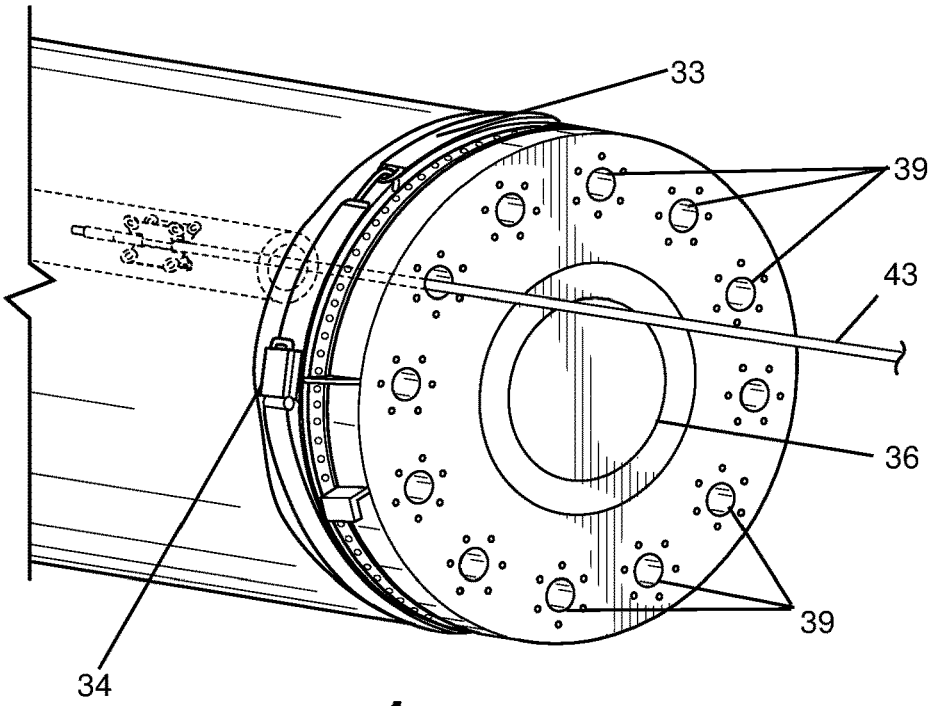
FIG. 4 is a close up front view of a preferred embodiment of an end cap of the present invention in place on a pipe with a cut-away showing the cleaning tool.
Figure 6:
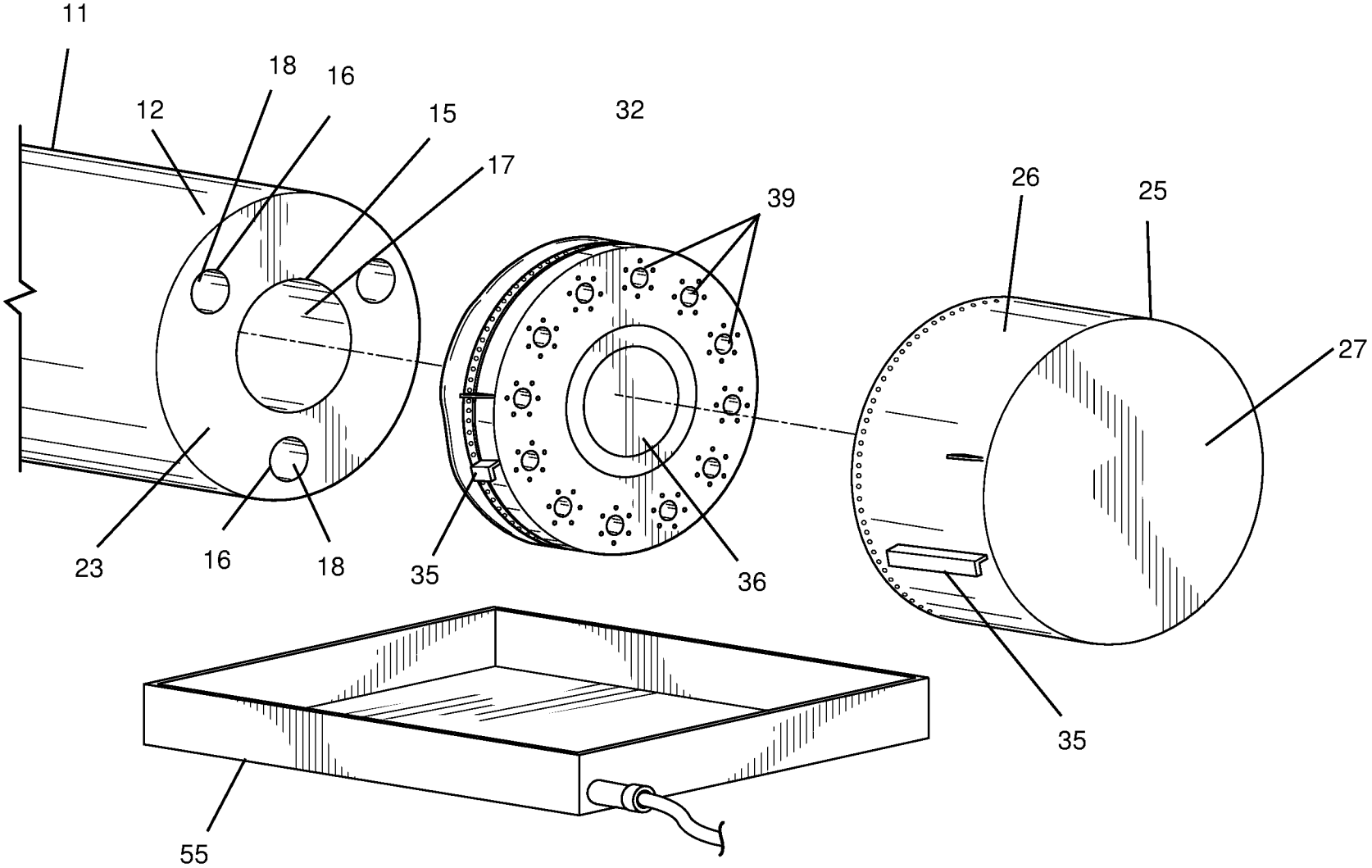
FIG. 6 is an exploded view of a preferred embodiment of the end cap, pipe, and drain pan of the present invention.

In a preferred embodiment, the circular wall 27 is provided with a plurality of openings as shown in FIGS. 4 and 6. These openings include central opening 36 and a plurality of peripheral openings 39. Each opening 36, 39 can be fitted with a flange 37 and a seal 38 (not shown). In one embodiment, the flange 37 is preferably bolted to the circular wall 27 with fasteners, thus sandwiching the seal 38 in between the flange 37 and the circular wall 27 (not shown).

Each peripheral opening 39 is preferably fitted with a flange 40 and can include a seal 38 as with the central opening 36 (not shown).

A hose 43 supplies pressurized fluid to cleaning tool 10. The seal 38 can have a small opening at 41 which allows insertion of the cleaning tool 10 and its pressurized hose 43 from the outer surface 31 of circular wall 27 to the inner surface 30 of circular wall 27, thus gaining access to the bore 17 or 18 of a selected larger diameter pipe 15 or smaller diameter 16 to be cleaned.

A hose feed device 44, such as AutoBox by StoneAge®, Model No. ABX-500, can be used to feed hose 43 into the selected bore 17 or 18 during cleaning, thus advancing the cleaning tool into and along a selected bore 17 or 18 until all of it is cleaned (i.e., inside surface of pipe 15 or 16).

Each cap or shroud 25 has an outlet fitting 45 to which is attached a suction line 46. The suction line 46 would be coupled to a pump or like device that pulls the suction on the outlet fitting 45 and thus the interior of the riser assembly 11. In one embodiment, caps or fittings or shrouds 25 are placed at both ends of the riser assembly 11, each of the caps or shrouds 25 having an outlet fitting 45 and a suction line 46. In this fashion, the suction lines 46 and their pumps assist in holding the caps or shrouds 25 to the riser assembly 11 by subjecting the entire interior of the riser assembly 11 to a vacuum. Hoses 47 (not shown) can be attached to each flange 37, 40. Such hoses 47 can be L-shaped and flexible. Hoses 47 discourage leakage of cleaning fluid from cap or fitting 25.

Once cleaning is finished, a camera or like device can be used for inspecting the bores 17 or 18 (not shown). A camera line 49 can be provided as well as a camera feed device 50 for inserting the camera into a selected bore 17 or 18 (not shown).

Whereas Applicant, has cleaned risers by sending a high pressure cleaning tool down only one of the holes, in the riser, by way of a pneumatic feeder, in order for the offshore cleaning method to be economically superior to traditional onshore cleaning, the cleaning preferably occurs in a faster total time and cleaning equipment preferably takes up less total space on the well. To accomplish a faster cleaning time, the method of the present invention includes the option of cleaning all of the bores of a riser simultaneously. The largest bore 17 will preferably be cleaned by sending a high pressure cleaning tool 10, by way of a pneumatic feeder 44 on one end 12, 13. The 3 or 4 smaller bores 18 will preferably be cleaned in the same aforementioned fashion either on the same or on the opposite end of the riser simultaneously.

To accomplish this faster cleaning while still taking up a smaller total space on the well, novel and improved cleaning tools and assembly have been developed. On one or both ends 12, 13 of the riser pipe 11, these cleaning tools 10 are being fed through the bores 17, 18 with high pressure water hoses preferably via pneumatic feeders 44.

Figure 2:
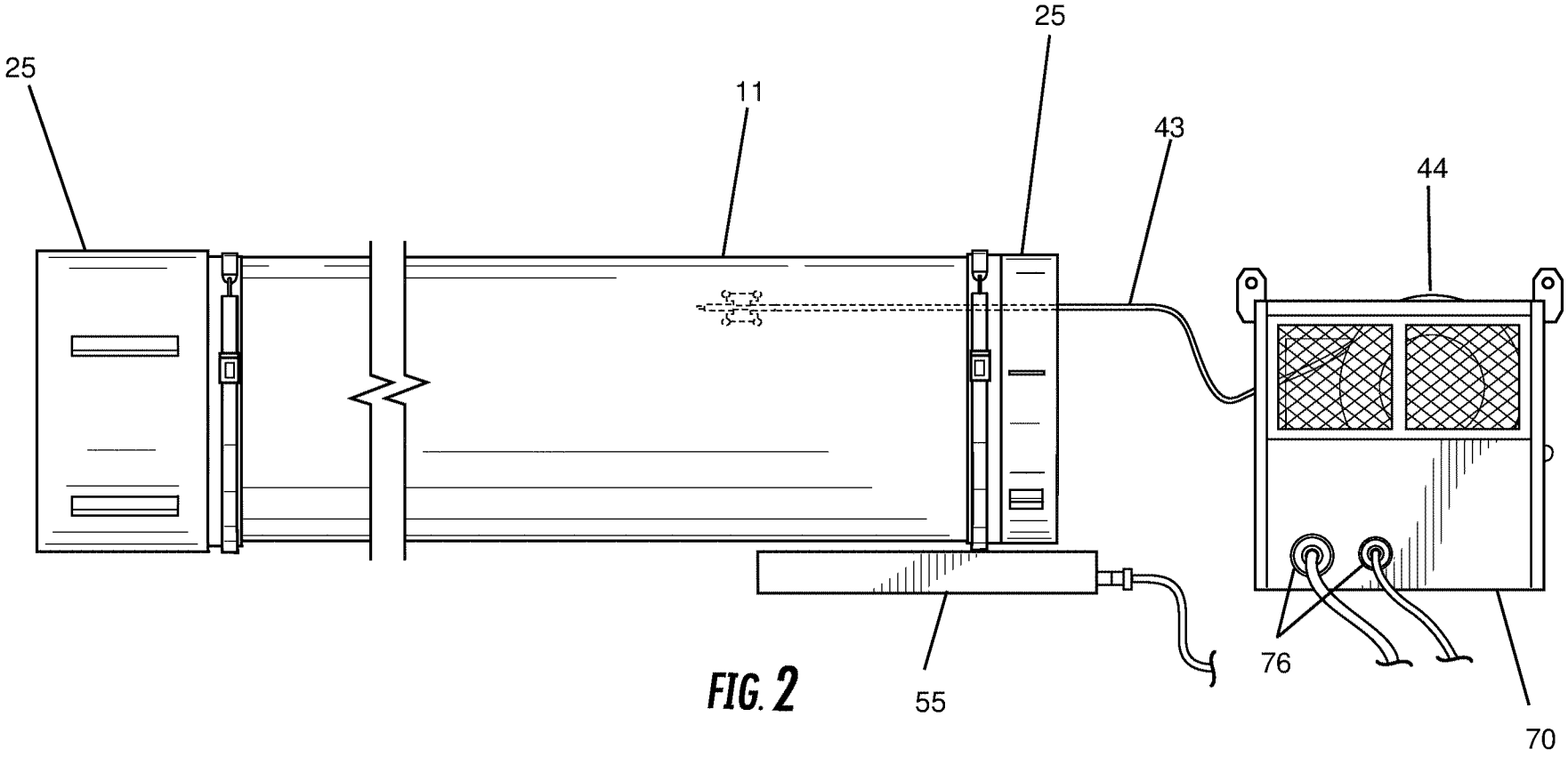
FIG. 2 is a schematic of a preferred embodiment of the method and apparatuses of the present invention with the cleaning tool in the pipe.

An improved control panel 60 shown in FIGS. 1-2 is able to control, preferably pneumatically, multiple high pressure water hose feeders 44. Control panel 60 as shown in FIG. 1, is controlling two feeders. However, the panel 60 may be adapted to control additional feeders 44, preferably 4 or 6 feeders 44.

Figure 8:
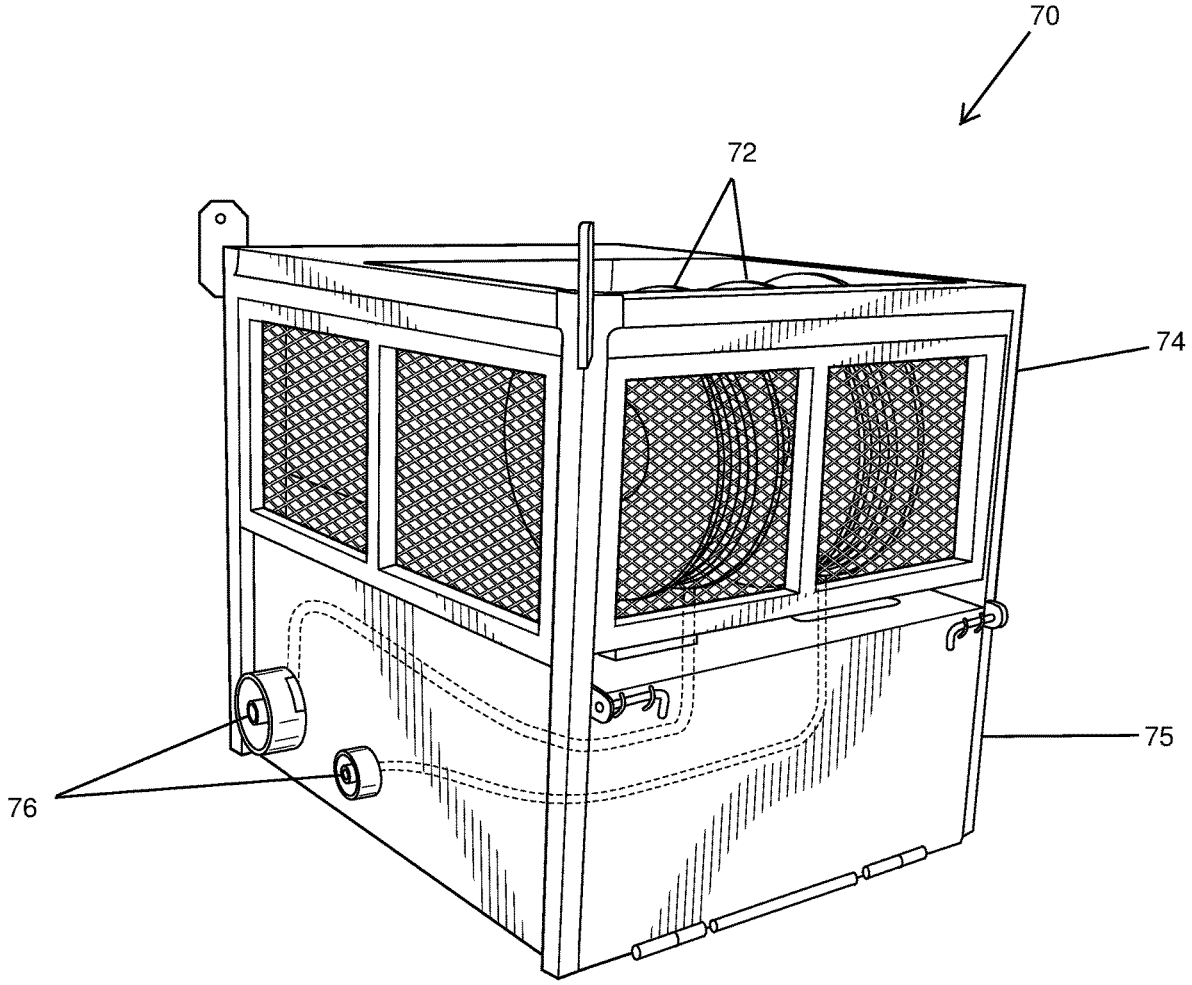
FIG. 8 is a perspective view of a preferred embodiment of the spool basket of the present invention.
Figure 9:
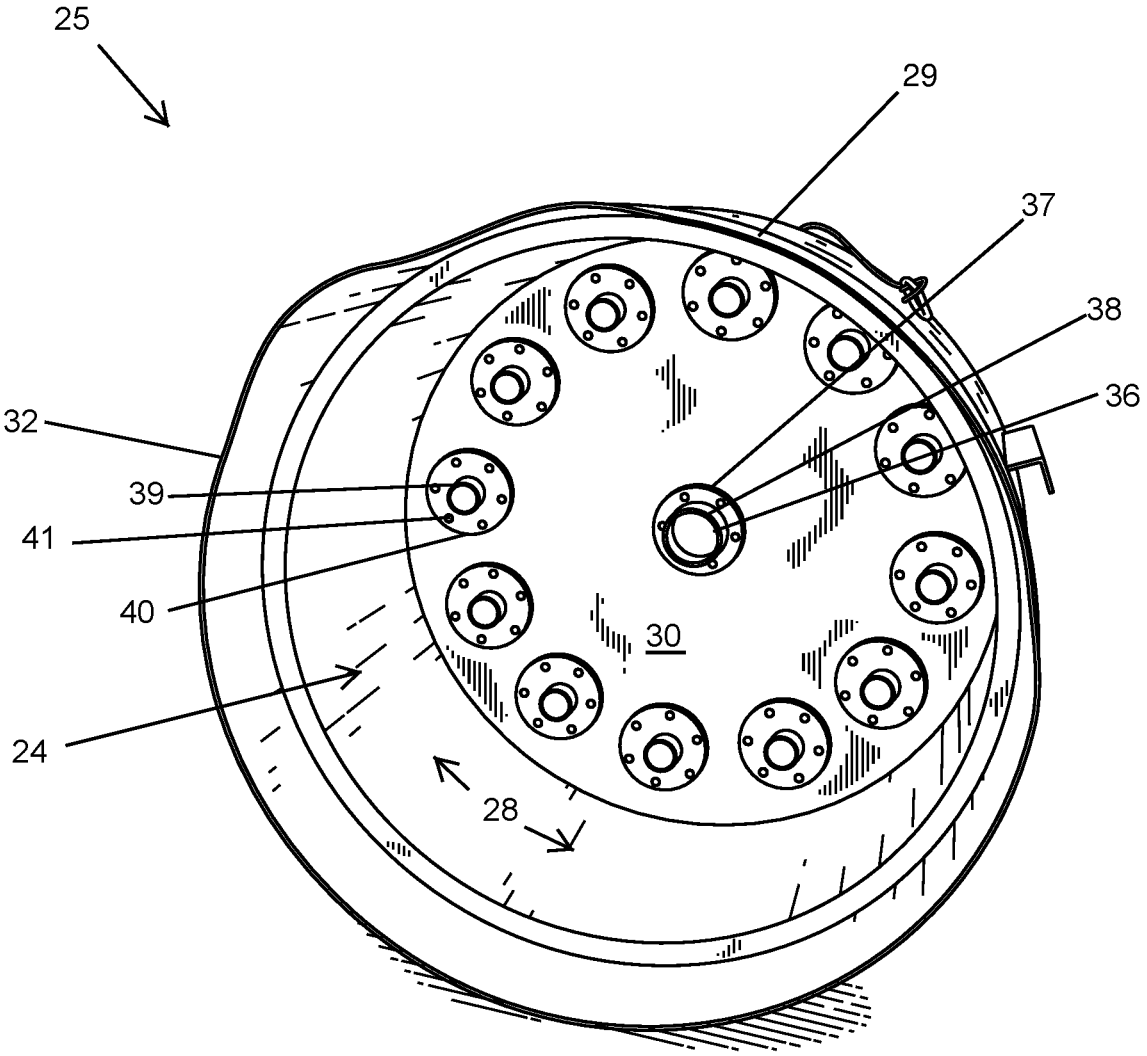
FIG. 9 is a perspective view of a preferred embodiment of the interior of the cap of the present invention.
Figure 10:
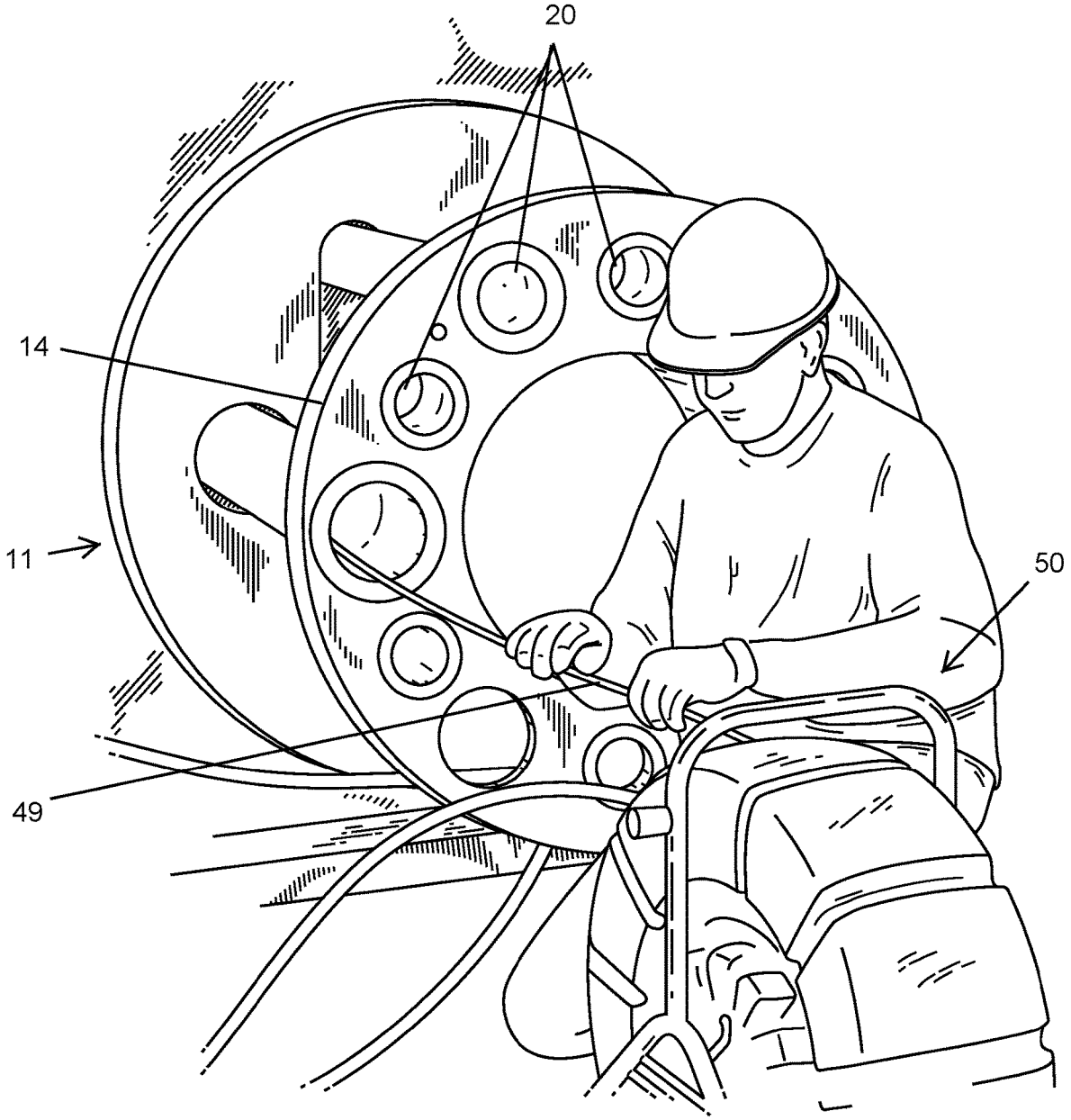
FIG. 10 is a close-up view of a step in a preferred embodiment of the method of the present invention.
Figure 11:
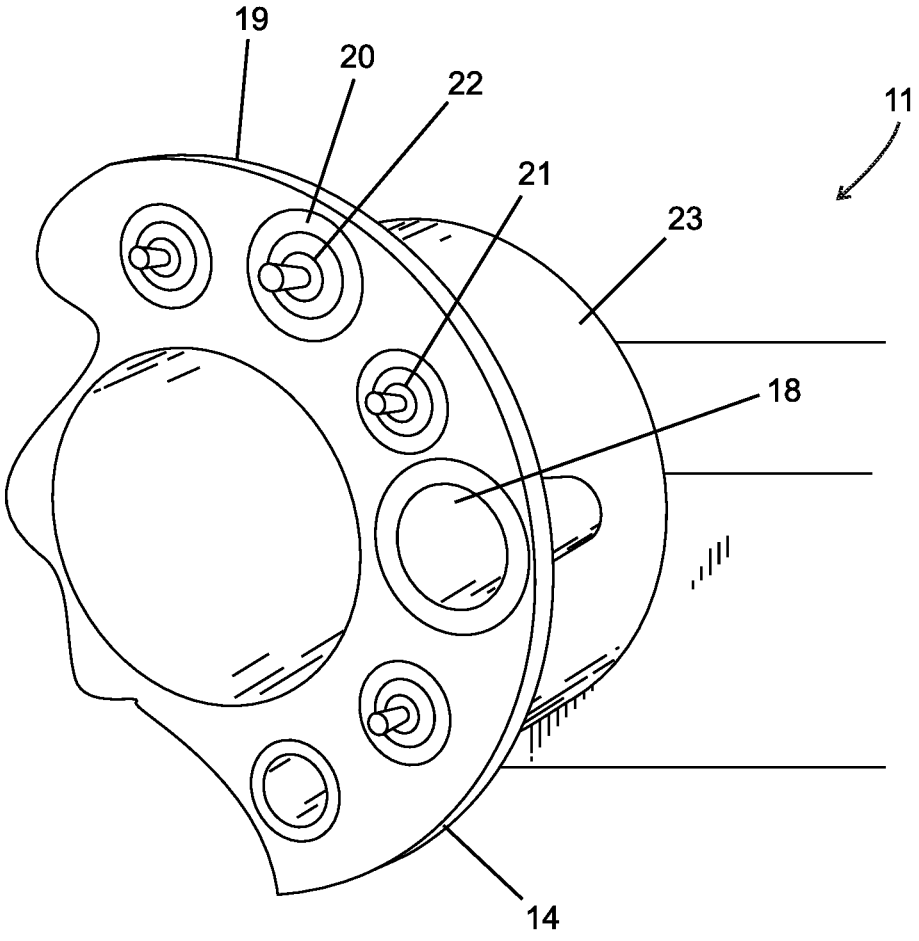
FIG. 11 a partial perspective view of a preferred embodiment of a riser assembly of the present invention.
Figure 12:
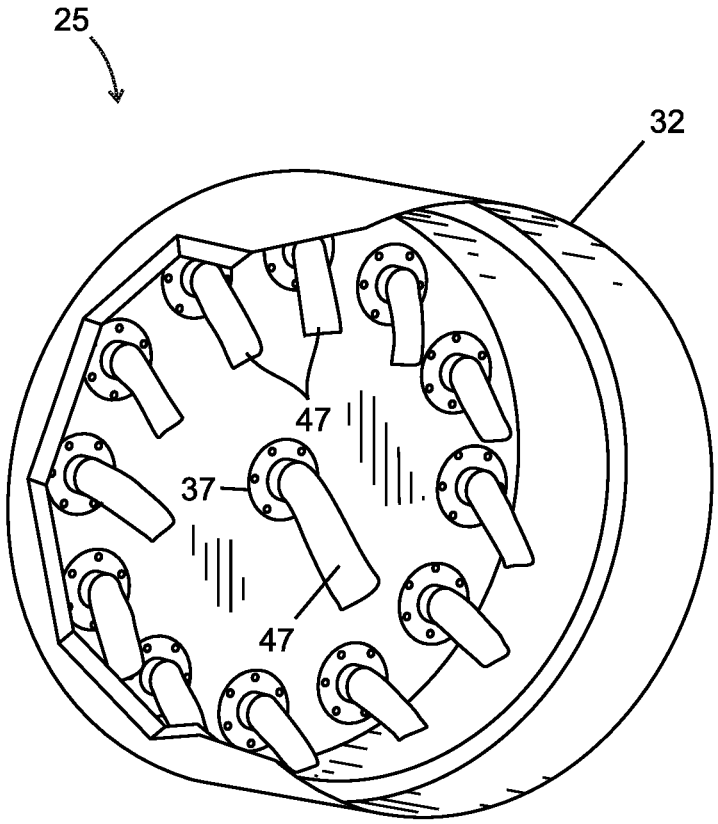
FIG. 12 is a cut-away view of a preferred embodiment of the interior of the cap of the present invention.
Figure 13:
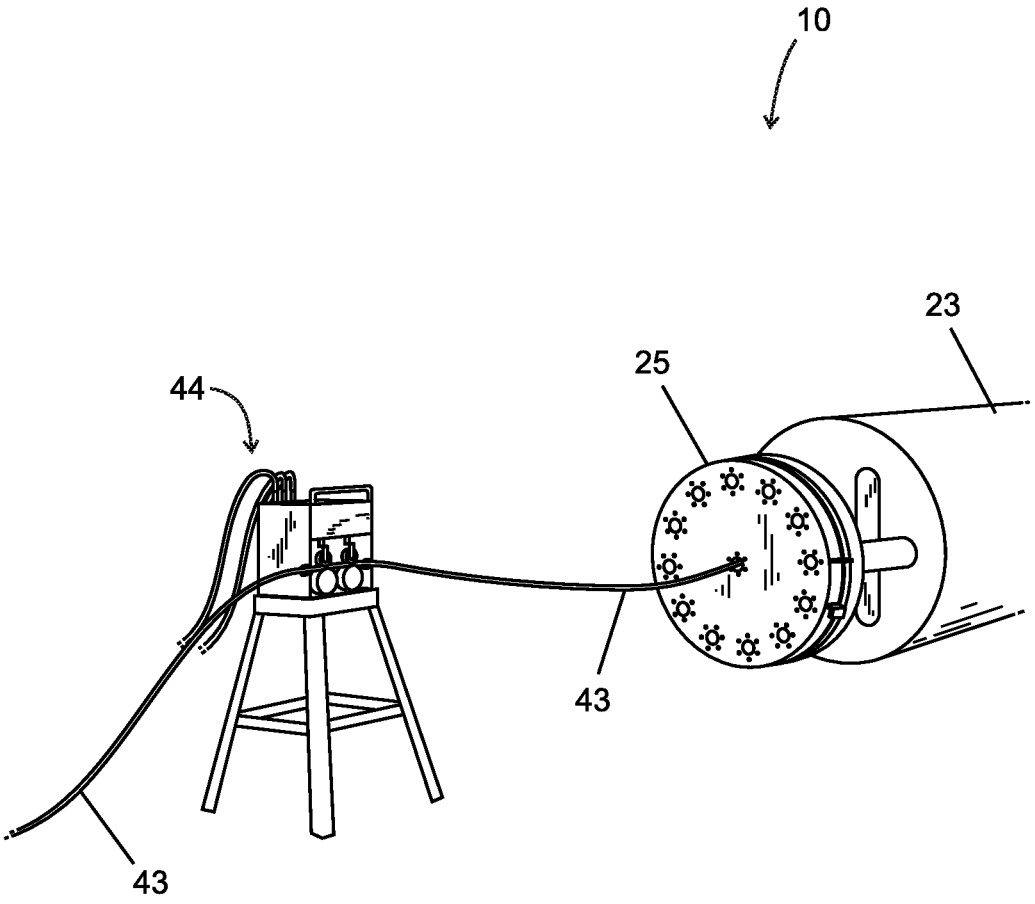
FIG. 13 is a view of a step in a preferred embodiment of the method of the present invention; and, FIG. 14 is a top view of a preferred embodiment of the control panel of the present invention.
Figure 14:
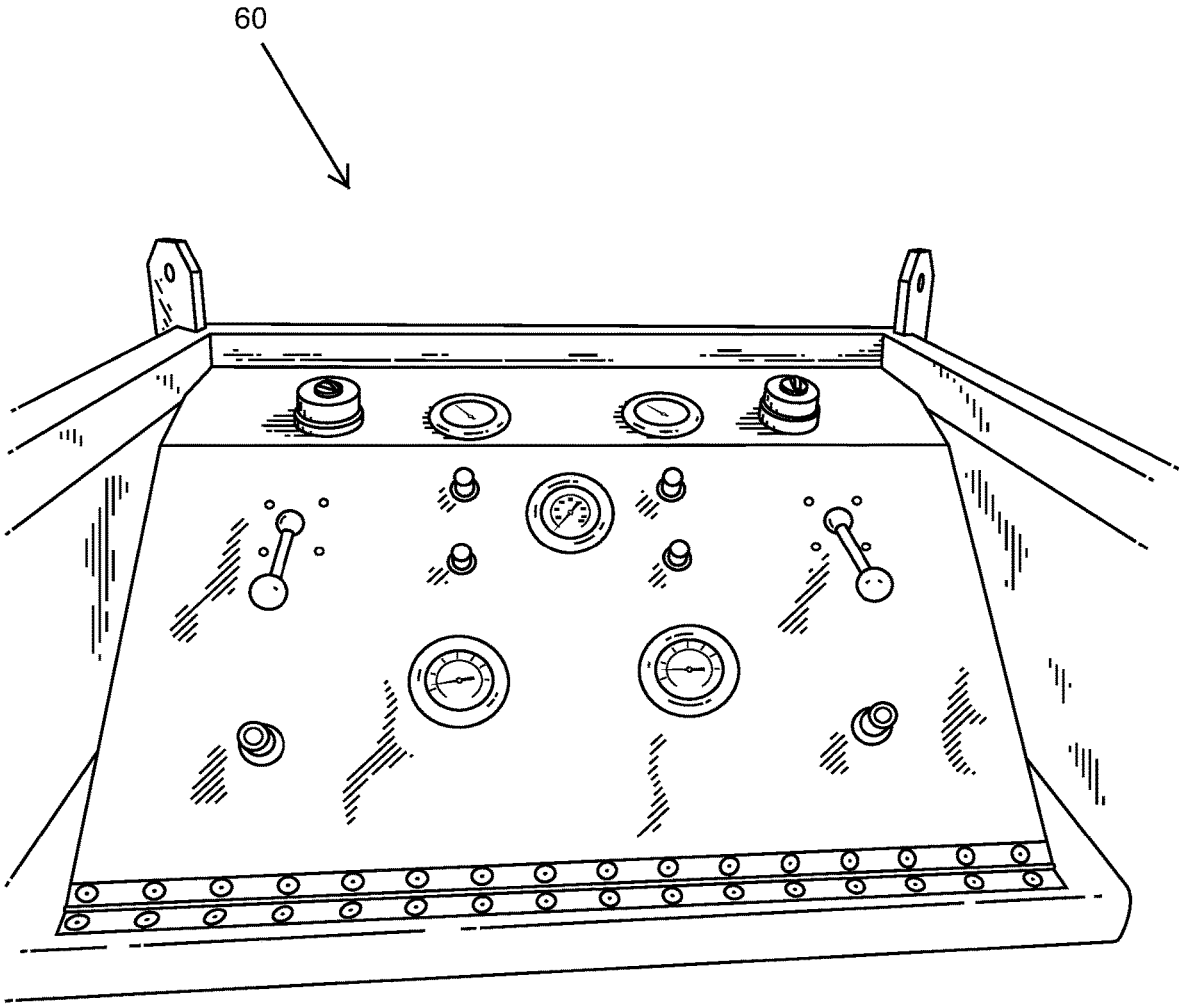

To further decrease the total footprint of the cleaning tools, a novel spool or reel basket 70 as shown in FIG. 8 has been developed. The spool basket 70 preferably has pad eyes for industrial transportation that hold the one or more pneumatic feeders 44 and one or more respective spools 72 of high pressure water hose 43. The spool basket 70 of the present invention as shown in FIG. 8 has an upper section 74 and lower section 75. The lower section is adapted with housings 76 for the high pressure water lines 43, power lines, and control lines for the pneumatic feeders 44. As shown, the lower section has housings 76 for two feeders 44; however, additional housing can be added to accommodate additional feeders 44. The upper section holds two pneumatic feeders 44 and two reels 72, the reels coordinate with each respective feeder 44. However, the basket 70 can be adapted to hold more feeders 44 and spools 72. Preferably, additional feeders 44 and spools 72 would be stored on top of the feeders 44 and spools 72 shown so that the total footprint of the equipment is not increased.

In a preferred embodiment, control panel 60 is preferably positioned to reduce the footprint. For example, control panel 60 may be positioned next to the spool basket 70.

In one embodiment, the output of water for 4 tools being run simultaneously is preferably 15 gallons per minute for the larger bore holes 16, and 8 gallons per minute for the choke, kill and boost lines.

In one embodiment, the output of water for 4 tools being run simultaneously is preferably 39 gallons per minute.

In one embodiment, the total time to clean is approximately 15 minutes.

The control panel 60 and spool basket 70 were invented for the purpose of controlling multiple high pressure water cleaning tools 10, simultaneously with minimal man power and minimal human exposure to moving parts.

In a preferred method, there are two control panels 60 and two spool baskets 70, with a spool basket 70 at each end of a riser 11, and the two control panels 60 can be side by side on one end 12, 13 or remote from one another. Preferably, there is a separate human operator for each control panel 60, though if they are side by side one human operator is preferably able to operate both.

In another preferred embodiment, the control panel 60 is adapted to control 4 or 6 feeders 44, all of which are housed in one spool basket 70 as described above, at one end of the riser pipe 11.

The cleaning method of the present invention preferably makes use of an improved pressure washing tool 10 that cleans the inside surface of the larger diameter tubular member 17 and other improved pressure washing tools 10 that clean the inside surface of the smaller diameter tubular members 18 simultaneously. A cable or hose 43 preferably supplies fluid under pressure to the cleaning tools 10.

Figure 7:
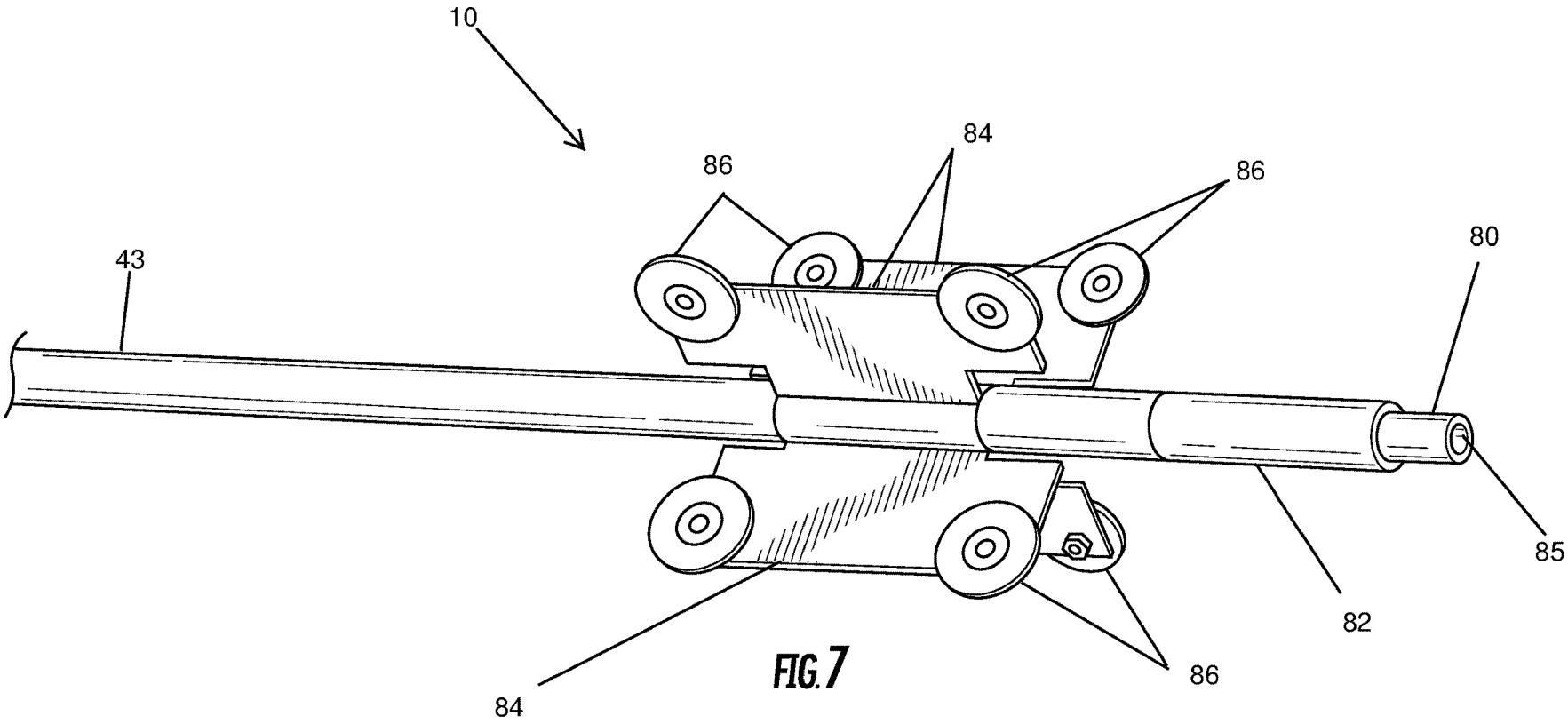
FIG. 7 is a perspective view of a preferred embodiment of the cleaning tool of the present invention.

In a preferred embodiment, the pressure washing tool 10 of the cleaning method includes a head 80 connected to a tubular body 82, and a support structure surrounding the tubular body 82. The head 80 preferably includes at least one orifice 85. The orifice(s) 85 of the head 80 preferably allow pressurized water to pass through during cleaning. In one embodiment (not shown), the head 80 also includes more than one opening along the same axis that preferably allows for a stabilizer bar to pass through the openings. In a preferred embodiment, the support structure is extensions 84 that extend radially from the tubular body 82 of the tool 10. Preferably there are at least 3 extensions 84. More preferably there are 4 extensions 84. Most preferred, the extensions 84 have one or more wheels 86, preferably two wheels 86 on each of four extensions 84, as shown in FIG. 7. This design is preferable because the extensions stabilize the tool in the center of the line, and the wheels alleviated drag providing for a faster cleaning time. Additionally, wear and tear on the tool 10 is decreased, which lengthens the life of the tool 10. In another embodiment, additional wheels may be added to the nose of the tool 10, to alleviate dipping of the nose during cleaning. In another embodiment (not shown), the support structure is comprised of 3 or more leg-like extensions, the leg-like extensions having a proximal portion and distal portion, wherein the proximal portion extends radially out from the tool 10, at an angle between 30 and 90 degrees from the tubular body, and wherein the distal portion is parallel to the inner wall of the bore 17, 18 to be cleaned. In this embodiment, the distal portion of the leg-like extension is equipped with one or more, preferably two, wheels that are adapted to roll along the inner wall of the bore 17, 18 to be cleaned. This embodiment may further include one or more wheels on the nose of the tool 10.

Prior versions of a cleaning tool for riser pipes did not have wheels 86 or extensions 84, which caused stripping of the tool. In those prior versions that did have extensions for support, the extensions were too short and allowed the nose of the tool to dip. Additionally, no wheels were provided which created significant drag in the riser that required more time and power to overcome.

In one embodiment of the present invention, the method of cleaning riser pipes is as follows:

1—Job Survey—

All PPE (personal protective equipment) to be worn is as follows; Hardhat, Steel-toed Boots, Safety Glasses, Flame Resistant Clothing (FRC) [Either coveralls of separate shirt/pants combinations], and Orange Reflective Vests. Equipment Operators will wear specialized PPE for optimal safety protection. One or more operators or crewmembers will survey conditions and check for hazards to ensure a safe operation. Operators or crewmembers will place equipment in a manner that avoids trip hazards and other safety hazards.

2—Equipment Setup—

A crewmember will begin running lines 43, 46. The crewmember will connect a water line 43 from the pump (not shown) to a water line housing 76 on the Spool Basket 70. The housing connects to a "Y" connection that routes the high pressure water to each spool 72. Each spool 72 then connects to the feeder 44.

One crewmember will set up diaphragm pumps, preferably 2 pumps, one for each end of the risers 11. Preferably, the diaphragm pumps are 2-inch pumps. The crewmember will then connect a discharge hose to the pump, preferably 2 hoses, also for each end of the risers. Preferably, the discharge hoses are 2-inch discharge hoses. The discharge hoses connect to the riser safety cap 25, preferably by way of a 2-inch female camlock located at the bottom of the cap.

Crewmembers will set up and place the discharge containment system catch pan 55 so that no discharge spills on the rig floor.

A crewmember will measure the depth of the rubber seals on both ends of each riser 11. Two markers will be placed on the lance-line signifying the corresponding depth of the rubber seals so as not to damage the rubber seals with, up to, 10,000 psi of water pressure.

Figure 3:
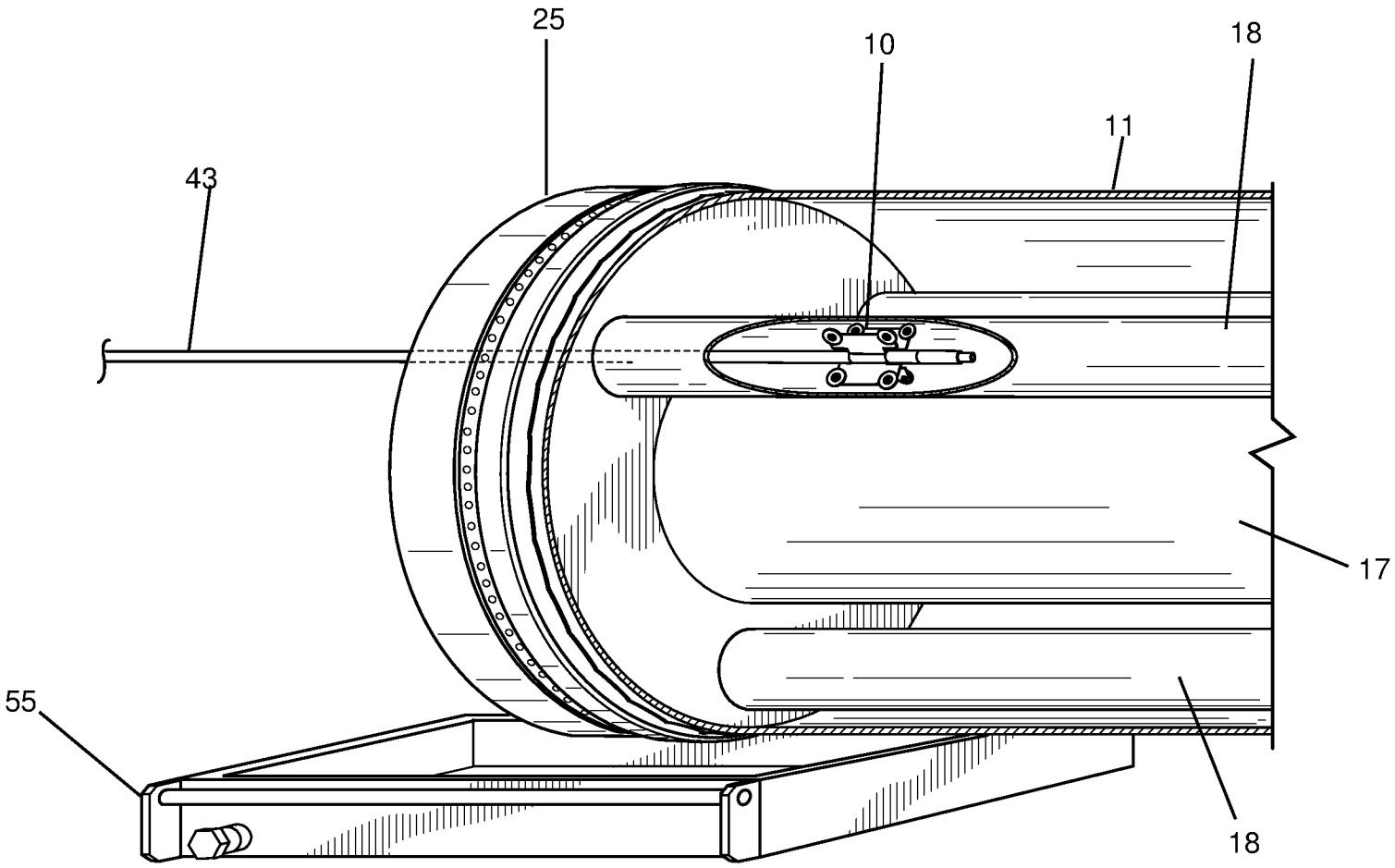
FIG. 3 is a close up side view of a preferred embodiment of the apparatus of the present invention with a cut-away showing the cleaning tool.
Figure 5:
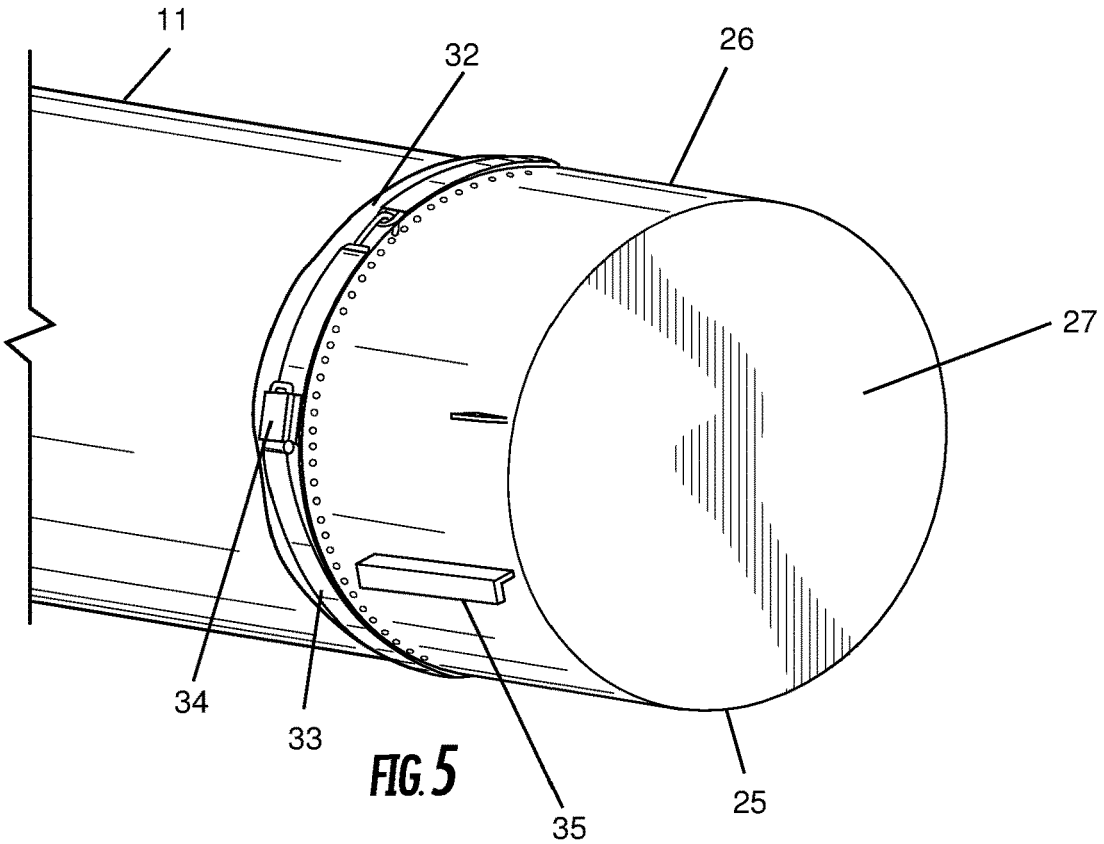
FIG. 5 is a close up front view of a preferred embodiment of an end cap of the present invention in place on a pipe.

The lance-lines 43 that coordinate with the one or more cleaning tools 10 will be threaded through the outside of the cap 25 inward, as shown in FIGS. 2-4. The lance-lines 43 will then be connected to the cleaning tools 10. The crewmembers will then close the SafetyCAP™ 25 over the OD of the riser 11 flange and secure it, preferably with a band clamp 33 as shown in FIGS. 4-5. (Installation of caps 25 on both ends is preferably identical.) On one end, crewmembers will rig up the cap 25, a preferably 2-inch suction hose 46, and the large and small cleaning tools 10 will be placed in their respective holes 15, 16. The pump will have a rig-water line connected to it.

SafetyCAPs 25 are to be installed. Crewmembers will install SafetyCAPs 25 on both ends 12, 13. On each end of the riser where they will secure the SafetyCAP 25 around the OD of the riser 11 flange with a band clamp/ratchet strap 51/33. The suction hose 46 will be connected to the 2" female Camlock 45 that is attached to the SafetyCAP™ 25. Any bolt-holes will be plugged up. The 2" suction hose 46 will be connected to the 2" diaphragm pump at the far end.

3—Operation—

Once all components have all connections secured, and all SafetyCAPs are installed, one or more lance-lines 43 with their respective tools 10 will be cleaning from one or both ends 12, 13.

The Control Panel 60 will actuate the feeders 44. With the water pressure high, the feeders 44 will begin tripping the tools 10 down the length of the riser 11. Once to the end of the riser 11, the feeder 44 will be set in reverse and begin pulling the tools/lance-lines 10/43 back. This action will re-spool the lance-lines 43 onto the spools 72 in the spool basket 70.

There are large tools 10 for large pipes 15 and small tools 10 for small pipes 16. The orifice(s) 85 in the tool 10 are preferably pointed to grab directionally forward for a faster initial trip.

Novel Improvements to the Apparatuses Used in the Method of the Present Invention:

Traditionally, a small cleaning tool, called a Banshee™, connected to a 6" stinger, was used to clean small holes in risers because it was small enough to fit in the auxiliary lines. The Banshee™ was small enough to be stung into the rubber seals of the caps; however the life of the Banshee™'s rotating mechanism was insufficient, and when rotating ceased, the tool would stripe interior surface area of auxiliary lines and the tool would bounce around on the inside of auxiliary lines. To improve on this, a slightly larger version of the Banshee™ called the Badger™ was developed. The Badger™ had a better rotating mechanism, so it was more dependable with no striping. Still, the Badger™ would eventually bounce around the inside of the lines, shortening the life of the tool. Our novel tool for cleaning small holes in risers improves even further on these two prior tools by adding centralizers or extensions 84, preferably with wheels 86, on the tail end of the tool 10. These improvements stabilize the tool 10 in the center of the bore 18, and alleviate drag providing for a faster cleaning time. Additionally, they lengthen the life of the tool.

A second novel cleaning tool 10 has been used for larger bore holes in the risers. The large tool is called a Raptor™. When in operation, the Raptor™ is connected to an 8" stinger. The Raptor™'s large size provided for a mostly adequate cleaning for the larger riser line. However, similarly to the problems with the original small tools, without centralizers, the Raptor™ striped the inside of the line, and, consequently, the Raptor™ also bounced around on the inside of the large line.

To eliminate these problems, centralizing fins have been added to the tool 10, and wheels were added to the nose. The fins centralize the tool in action, so there is less bouncing, and the wheels on the nose help to alleviate the dipping. But, neither the fins nor the wheels completely prevent the tool's nose from dipping, which causes the tool to stripe.

Novel improvements include specially fabricated centralizers 84 with a longer and larger frame with wheels 86 have been added to the cleaning tool 10 to overcome the problems of the prior tools used. The wheels 86 alleviate drag. Additionally, the tool 10 is preferably machined with larger orifices 85, and with at least four 15° fan tips to help eliminate striping and provide for uniformed cleaning.

Traditional control panels for riser cleaning operations have controls for only one feeder and reel and utilize a separate foot pedal. This Control Panel allowed the operator to control the feeder pneumatically from a distance; however, the design of the tool's footprint, although low, was not efficient in consolidating the hoses that connect to it. Additionally, the Control Panel could only handle connection to 1 feeder, which is insufficient for cleaning multiple riser lines simultaneously. Finally, the foot pedal, which when engaged, allowed the high pressure water to flow, was separate from the system. This was time consuming to set up and took up additional space on the well.

Improvements have been made so the preferred control panel 60 of the present invention allows for control of multiple feeders 44 and reels 72. The control panel 60 consolidates the pneumatic hoses that connect to the feeder 44. This Control Panel 60 has the capabilities of controlling more than one feeder 44 simultaneously. In a preferred embodiment, shown in the figures, 2 feeders 44 are controlled simultaneously. In another embodiment, 4 feeders 44 are controlled simultaneously from the Control Panel 60. Additional feeders may also be added. This Control Panel 60 is smaller, which cuts our footprint from older control panels in half. Additionally, this improved Control Panel 60 incorporates the foot pedal into the panel board and is controllable by a toggle switch, further reducing the footprint of the equipment needed for the method.

The feeder 44 used in the method of the present invention is preferably controlled pneumatically. The feeder 44 clamps down on the high-pressure water lines (lance lines) 43. When actuated forward or backward, the lance line 43 will move forward and backward. This motion allows us to control the tripping of the lance line 43 and corresponding cleaning tool 10 down the length of the riser 11. The pneumatic feeder 44 allows the operator to trip the lance line 43 forward and backward in the riser 11, and it is light in weight and portable. However, there is no way to organize and consolidate the air hoses and lance lines to lessen the footprint, especially where multiple lines are to be operated simultaneously, requiring multiple feeders. This would create multiple tripping hazards and more time than would be allotted to set up. Thus, we created the spool basket 70 of the present invention. In a preferred embodiment, the novel Spool Basket 70 is a portable enclosed tool box with 2 or more feeders 44, 2 or more spools 72 with lance lines 43 corresponding to the feeders 44, and connections or housings 76 for pneumatic hoses and high pressure water lines to connect to their respective tools. This basket 70 is comprised of 2 or more feeders 44, 2 or more lance line spools 72, and housings 76 for pneumatic and water hoses lessening the footprint, and eliminating a number of tripping hazards. The Spool Basket 70 preferably has wheels (not shown), making it extremely portable. And, the feeders 44 are positioned for ease of lance line 43 access to entry ports 36, 39 on the cap(s) 25.

Safety caps 25 are used on the ends of the riser 11 to contain discharge while maintaining the ability to stab the lance line 43 through a small hole 36, 39 in the cap 25. The cap 25 is preferably reinforced with aluminum, and rubber tubes are preferably placed on the interior of the stabbing holes to eliminate back pressured discharge. Multiple stabbing holes 36, 39 allow for multiple tools 10 and lines 43 to work in the cap 25 simultaneously. Finally, the addition of a discharge line 46, repositioned at a 90° angle allows for discharge back pressured waste A second safety cap 25 allows for capture of discharge, discharge pump-off, and cleaning from the opposite side of the riser 11. Preferably, a cavity is added for the large bore 17 so that a cleaning tool 10 can fit in and properly flush out the discharge.

The following is a list of parts and materials suitable for use in the present invention:

PARTS LIST

| PART NUMBER | DESCRIPTION |
|---|---|
| 10 | riser cleaning apparatus |
| 11 | riser assembly |
| 11A | riser assembly |
| 12 | first end portion |
| 13 | second end portion |
| 14 | annular flange |
| 15 | larger diameter pipe |
| 16 | smaller diameter pipe |
| 17 | pipe bore (larger diameter) |
| 18 | pipe bore (smaller diameter) |
| 20 | opening |
| 21 | plug |
| 22 | plug |
| 23 | insulation/protective covering |
| 24 | concave portion/cavity |
| 25 | cap/shroud/fitting |
| 26 | cylindrical section |
| 27 | circular wall |
| 28 | inner surface |
| 29 | outer surface |
| 30 | inner surface |
| 31 | outer surface |
| 32 | gasket/seal |
| 33 | band |
| 34 | fastener/rivet |
| 35 | handle |
| 36 | central opening |
| 37 | flange |

-continued

| PART NUMBER | DESCRIPTION |
|---|---|
| 38 | seal |
| 39 | peripheral opening |
| 40 | flange |
| 41 | opening |
| 43 | hose |
| 44 | hose feed device |
| 45 | outlet fitting |
| 46 | suction line |
| 47 | hose |
| 49 | camera line |
| 50 | camera feed device |
| 51 | strap |
| 55 | catch pan |
| 60 | control panel |
| 70 | spool basket |
| 72 | reels or spools |
| 74 | upper section of spool basket |
| 75 | lower section of spool basket |
| 76 | housings |
| 80 | nozzle of cleaning tool |
| 82 | tubular member of cleaning tool |
| 84 | extensions |
| 85 | orifice(s) of cleaning tool |
| 86 | wheels |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of cleaning an oil and gas well riser section that has a central larger diameter tubular member having a flow bore and a plurality of smaller diameter tubular members connected to the central larger diameter tubular member, each smaller diameter tubular member having a flow bore, the method comprising the steps of;

a) placing a fitting on an end portion of the riser section, the fitting registering upon an end of the larger diameter tubular member and the ends of the smaller diameter tubular members, wherein the fitting has multiple openings including one or more centrally located openings and a plurality of circumferentially spaced apart outer openings that are spaced radially away from each of the one or more centrally located openings;

b) inserting a cleaning tool through the centrally located opening and into the larger diameter tubular member, wherein said cleaning tool cleans the inside surface of the larger diameter tubular member;

c) inserting one or more cleaning tools through one or more of the outer openings and into one or more of the smaller diameter tubular members, wherein said cleaning tool or tools cleans the inside surface of each of the smaller diameter tubular members; and d) collecting fluid from the cleaning operations of steps (a) through (c); and e) wherein the outer openings are positioned along a curved line that is radially spaced outwardly of the centrally located openings, said curved line traversing each of said smaller diameter tubular members.

2. The method of claim 1, wherein each said one or more centrally located openings is generally aligned with the bore of the larger diameter tubular member.

3. The method of claim 1, wherein each said outer opening is generally aligned with the bore of a said smaller diameter tubular member.

4. The method of claim 1, wherein the riser section has one end portion with an annular flange, each tubular member connected to said flange, and in step "a" the fitting attaches to said annular flange.

5. The method of claim 4, wherein the flange has an outer diameter and the fitting has a peripheral skirt having a diameter that is about equal to the flange outer diameter and step "a" includes attaching the fitting at the peripheral skirt to the annular flange.

6. The method of claim 1, wherein there are a pair of said fittings and a said fitting is attached to each end portion of the riser section in step "a".

7. The method of claim 6, wherein a suction is applied to each of the fittings to subject all said flow bores of the riser section to a vacuum during steps "a" through "d".

8. The method of claim 7, wherein the vacuum at least in part holds the fittings to the riser section.

9. The method of claim 1, wherein there are at least three outer openings.

10. The method of claim 9, wherein said cleaning tool cleans the inside surface of the larger diameter tubular member while simultaneously or substantially simultaneously a second, third, and fourth cleaning tool clean the inside surfaces of the smaller diameter tubular members.

11. The method of claim 9, further comprising as many separate cleaning tools as there are tubular members, and wherein all cleaning tools simultaneously or substantially simultaneously clean the inside surfaces of the tubular members.

12. The method of claim 1, wherein there are between three and twenty outer openings.

13. The method of claim 12, wherein the outer openings fall on a circle.

14. The method of claim 1, wherein some of the outer openings are aligned with a smaller diameter tubular member bore and some of the outer openings are not aligned with a smaller diameter tubular member bore.

15. The method of claim 1, wherein said first cleaning tool cleans the inside surface of the larger diameter tubular member while simultaneously or substantially simultaneously a said second cleaning tool cleans the inside surface of the smaller diameter tubular member.

16. The method of claim 1 wherein said cleaning tool has at least three leg extensions, the leg extensions each having a proximal portion attached to the tool that extends radially from the tool, and a distal portion that is parallel to the inner wall of the tubular member.

17. The method of claim 16 wherein the distal portion of the leg extensions also have one or more wheels on each leg, the wheels adapted to roll along the inner wall of the tubular member.

18. The method of claim 1 wherein the cleaning tools have at least three extension members that extends radially from the tool the extension members having a proximal edge that is parallel to the tool, and a distal edge that is parallel to the inner wall of the tubular member.

19. The method of claim 18 wherein the distal edge of the extension members also have one or more wheels on each extension member, the wheels adapted to roll along the inner wall of the tubular member.

20. The method of claim 1 wherein the one or more cleaning tools are housed in a spool basket that has a lower portion and an upper portion, the lower portion comprising housings for high pressure air and water lines, and the upper portion adapted for housing two or more spool feeders, and two or more spools, having one spool and one spool feeder for each cleaning tool.

21. The method of claim 20 wherein the spool basket is further connected to a control panel, the control panel adapted to control all of the cleaning tools simultaneously.

22. The method of claim 20 wherein the spool feeder is pneumatic.

23. A method of cleaning an oil and gas well riser section while on location at an offshore well, the riser section having a central larger diameter tubular member having a flow bore and a plurality of smaller diameter tubular members connected to the central larger diameter tubular member, each smaller diameter tubular member having a flow bore, the method comprising the steps of;

a) placing a fitting on an end portion of the riser section, the fitting attaching to an end of the larger diameter tubular member and registering with the ends of the smaller diameter tubular members, wherein the fitting has multiple openings including one or more centrally located openings and a plurality of circumferentially spaced apart outer openings that are spaced radially away from each of the one or more centrally located openings;

b) inserting a cleaning tool through the centrally located opening and into the larger diameter tubular member, wherein said cleaning tool cleans the inside surface of the larger diameter tubular member;

c) inserting one or more cleaning tools through one or more of the outer openings and into one or more of the smaller diameter tubular members, wherein said cleaning tool cleans the inside surface of the smaller diameter tubular member; and d) collecting fluid from the cleaning operations of steps (a) through (c); and e) wherein the outer openings are positioned along a curved line that is radially spaced outwardly of the centrally located openings, said curved line traversing each of said smaller diameter tubular members.

24. The method of claim 23, further comprising a step after step (a) of:

placing a fitting on an opposite end portion of the riser section, the fitting covering an opposite end of the larger diameter tubular member and flange, and the ends of the smaller diameter tubular members, wherein the fitting has multiple openings including one or more centrally located openings and a plurality of circumferentially spaced apart outer openings that are spaced radially away from each of the one or more centrally located openings, wherein one or both of said fittings has a drain opening.

25. The method of claim 23 wherein the cleaning tools are connected to high pressure water lines on spool feeders.

26. The method of claim 25 wherein the spool feeders are pneumatic.

27. The method of claim 25 wherein the spool feeders are controlled simultaneously by a nearby control panel.

28. The method of claim 25 wherein the spool feeders are housed in a compact spool basket adapted to be placed on the offshore well.

* * * * *